US007228834B2

(12) United States Patent
Letourneau

(10) Patent No.: US 7,228,834 B2
(45) Date of Patent: Jun. 12, 2007

(54) INTAKE MANIFOLD BLADE TO RUNNER ALIGNMENT

(75) Inventor: Mark Letourneau, Dover Centre (CA)

(73) Assignee: Siemens Canada Limited, Chatham (CA)

( * ) Notice: Subject to any disclaimer, the term of this patent is extended or adjusted under 35 U.S.C. 154(b) by 0 days.

(21) Appl. No.: 11/185,564

(22) Filed: Jul. 20, 2005

(65) Prior Publication Data

US 2007/0017467 A1 Jan. 25, 2007

(51) Int. Cl.
*F02M 35/10* (2006.01)

(52) U.S. Cl. ..... 123/184.21; 123/184.38

(58) Field of Classification Search ..... 123/184.21, 123/184.61, 336, 337, 184.38
See application file for complete search history.

(56) References Cited

U.S. PATENT DOCUMENTS 6,371,819 B1 * 4/2002 Ozawa et al. ..... 440/1

FOREIGN PATENT DOCUMENTS

GB 2391907 A * 2/2004

* cited by examiner

*Primary Examiner*—Stephen K. Cronin
*Assistant Examiner*—Hyder Ali

(57) ABSTRACT

An intake manifold assembly includes a housing, a shaft assembly, an intake insert, and a flange seal. Bushings are located at each end of the shaft and spaced along the shaft to absorb vibrations and provide a low friction surface for shaft assembly rotation. In addition, the bushings allow for differences in the thermal expansion of the shaft and the intake manifold housing. A bearing is located adjacent a shaft locator to provide a hard mounting surface for the shaft assembly when assembled with the housing.

18 Claims, 4 Drawing Sheets

INTAKE MANIFOLD BLADE TO RUNNER ALIGNMENT

BACKGROUND OF THE INVENTION

The invention is an arrangement for aligning a shaft assembly within an intake manifold housing and for reducing vibrations to the shaft assembly.

An intake manifold controls the amount of air entering an internal combustion engine. Air enters the intake manifold and flows through to the engine. Intake manifolds use shaft and blade assemblies to control the intake of air into the manifold assembly and through to the engine.

The shafts have commonly been manufactured from plastic and coated with rubber to lower vibration and noise. However, the plastic shafts have low durability and strength.

During manufacture imperfections may occur in the shaft, other assembly components, and the manifold housing due to manufacturing tolerances. The imperfections in the shaft assembly and manifold housing may lead to misalignment of the shaft when assembled into the intake manifold housing. The imperfections may be minimal while at rest. However, during operation of the vehicle misalignment of the shaft assembly may cause non-circular rotation of the shaft assembly. The non-circular rotation creates noise. In addition, imperfect fit between the shaft and manifold housing causes the shaft to vibrate against the manifold housing during engine operation. The vibrations also create chatter noise.

Because the shaft must be free to rotate within the manifold housing any components used for limiting vibration must be low friction to not hamper the shaft rotation.

An arrangement for shaft assemblies in intake manifolds to reduce vibration noise during engine operation is needed.

SUMMARY OF THE INVENTION

An intake manifold assembly includes a housing, a shaft assembly, an intake insert, and a flange seal. Multiple blades and a locator are positioned on the shaft at spaced intervals. The blades are used to control airflow within the intake manifold assembly. The shaft is rotated to move the blades, opening and closing an air passageway within the intake manifold assembly. The locator assists in marking the rotational position of the shaft to determine if the blades are in an open or closed position.

The shaft may be manufactured from metal, preferably aluminum. Bushings are located at each end of the shaft and also spaced along the shaft. The bushings are preferably two-part bushings with rubber seals and plastic sleeves. The rubber seals absorb vibrations and the plastic sleeves assist is providing a low friction surface for shaft assembly rotation. In addition, the bushings allow for differences in the thermal expansion of the shaft and the intake manifold housing. Journal pockets in the housing and in the intake insert surround the bushings. Isolators located within the journal pockets surround the bushings and assist in dampening vibrations.

A bearing is located adjacent the locator to provide a hard mounting surface for the shaft assembly when assembled with the housing. The bearing supports the shaft within the housing and allows the shaft to freely rotate. Load is applied on the bearing to hold the shaft assembly rigid within the housing. The bearing is low friction and assists in correcting any non-circular rotation of the shaft that may result from manufacturing tolerances. A support on the intake insert at least partially surrounds the bearing once assembled. When the intake manifold assembly is mounted to the engine the support applies load to the bearing to retain the shaft within the housing.

These and other features of the present invention can be best understood from the following specification and drawings, the following of which is a brief description.

DETAILED DESCRIPTION OF THE PREFERRED EMBODIMENT

Figure 1:
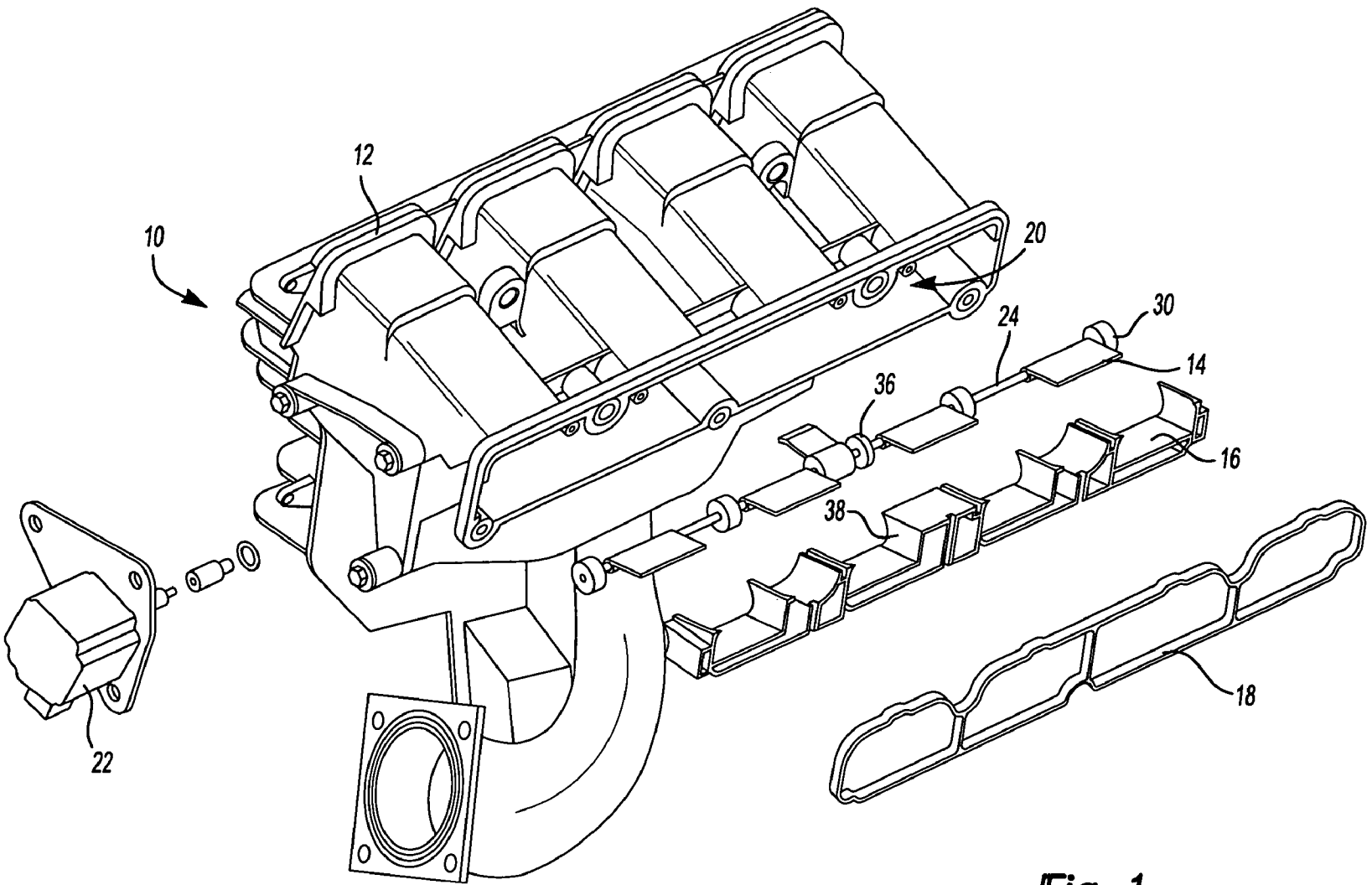
FIG. 1 is an exploded view of an intake manifold housing and intake shaft assembly.

FIG. 1 shows an intake manifold assembly 10. The intake manifold assembly 10 includes a housing 12, a shaft assembly 14, an intake insert 16, and a flange seal 18. The shaft assembly 14 is assembled into an opening 20 within the housing 12. The intake insert 16 is placed within the opening 20 to retain and support the shaft assembly 14. The flange seal 18 is assembled last. The flange seal 18 seals around the opening 20 once the intake manifold assembly 10 is mounted to the engine. Bolts or other fasteners may be used to retain the shaft assembly 14 within the housing 12 until the intake manifold assembly 10 can be mounted to the engine. Once mounted to the engine1 the shaft assembly 14 is held in place by the engine. An actuator 22 is mourned on the housing 12. Following assembly, the actuator 22 is connected to the shaft assembly 14. During operation of the engine, the actuator 22 controls airflow through the main passage of the intake manifold assembly 10 by rotating the shaft 24.

Figure 2:
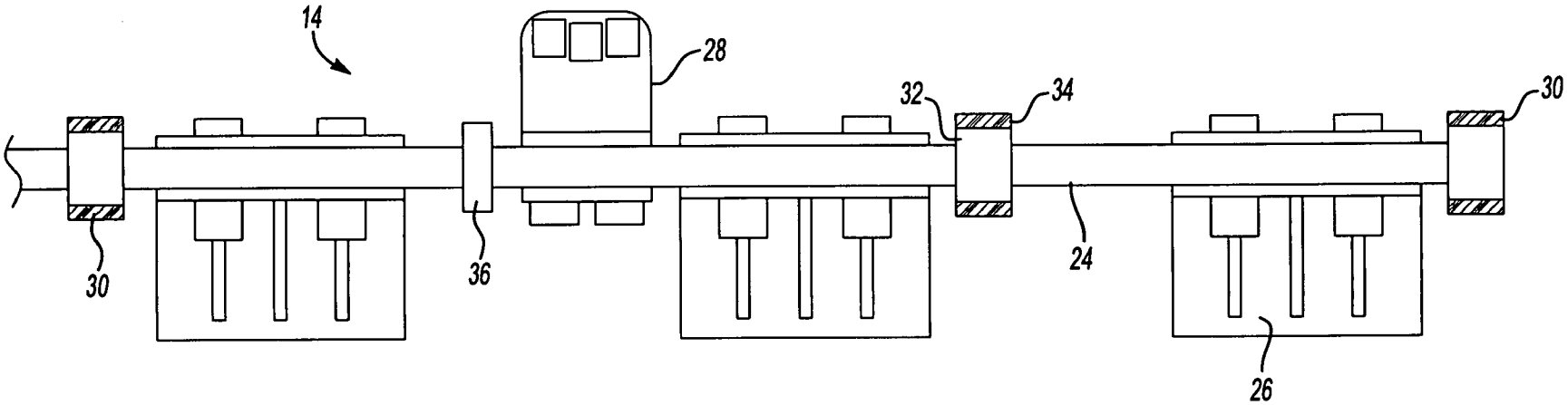
FIG. 2 is a perspective view of an intake shaft assembly.

FIG. 2 shows a perspective view of the shaft assembly 14. The shaft 24 is manufactured from metal. The example shaft 24 is fabricated from aluminum. The intake manifold housing 12 (shown in FIG. 1) is manufactured from a metal with a similar thermal expansion coefficient. Thus, differences in the thermal expansion of the housing 12 and the shaft 24 are reduced. Blades 26 mounted on the shaft open and close, corresponding to the rotational position of the shaft 24. A locator 28 is also mounted on the shaft 24 to assist in determining the rotational position of the shaft 24, as known.

The shaft assembly 14 includes bushings 30 located at each end. The bushings 30 are also spaced along the shaft 24. The bushings 30 are preferably two-part bushings 30 with rubber seals 32 and plastic sleeves 34. In addition to sealing, the rubber seals 32 absorb vibrations from the shaft assembly 14 and the housing 12. Vibrations created by the engine and by rotation of the shaft 24 during operation result in noise. The rubber seals 32 absorb the vibrations. The plastic sleeves 34 assist is providing a low friction surface for shaft assembly 14 rotation within the housing 12. The bushings 30 are considered soft mounts because load is not applied to the exterior surface of the bushings 30. In addition to sealing and reducing vibrations, the bushings 30 assist in accommodating any differences that still exist in the thermal expansion of the shaft 24 and the housing 12. The rubber seals 32 absorb changes in the fit between the shaft 24 and housing 12 created by differing thermal expansion between the housing 12 and the shaft 24.

A bearing 36 is located on the shaft 24 adjacent to the locator 28. The bearing 36 provides a hard mounting surface for the shaft assembly 14 when assembled with the housing 12. Load is applied from the housing 12 on the bearing 36 once the intake manifold assembly 10 is mounted to the engine. The fasteners retaining the engine and the intake manifold assembly 10 are tightened. Tightening the fasteners results in the intake manifold housing 12 and intake insert 16 being pressed together. Load is applied to the bearing 36 by the intake manifold housing 12 and the intake insert 16 because the bearing 36 is situated between the intake manifold housing 12 and the intake insert 16. The load holds the shaft assembly 14 rigid within the housing 12. Therefore, the bearing 36 fixes the position of the shaft assembly 14 within the housing 12. In addition, the bearing 36 is low in friction and assists in correcting any non-circular of the shaft assembly 14 that may results from imperfect manufacturing.

Figure 3:
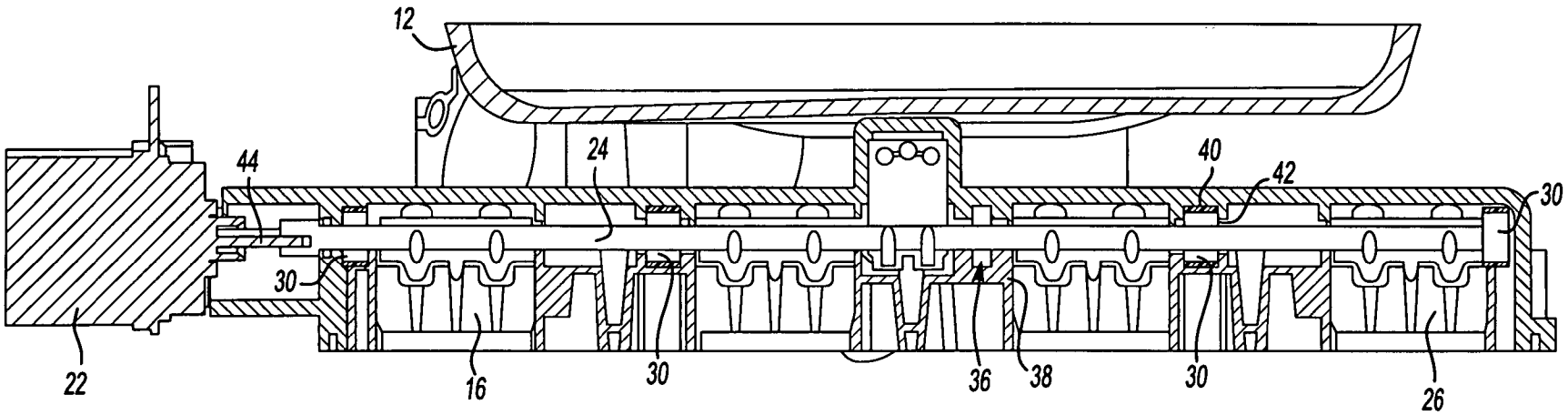
FIG. 3 is an end view of the assembled intake manifold and the shaft assembly.

FIG. 3 shows an end view of the intake manifold assembly 10. A support 38 on the intake insert 16 and a corresponding support 38 within the housing 12 at least partially surrounds the bearing 36 once assembled. The support 38 applies load to the bearing 36 to retain the shaft 24 within the housing 12.

Figure 4:
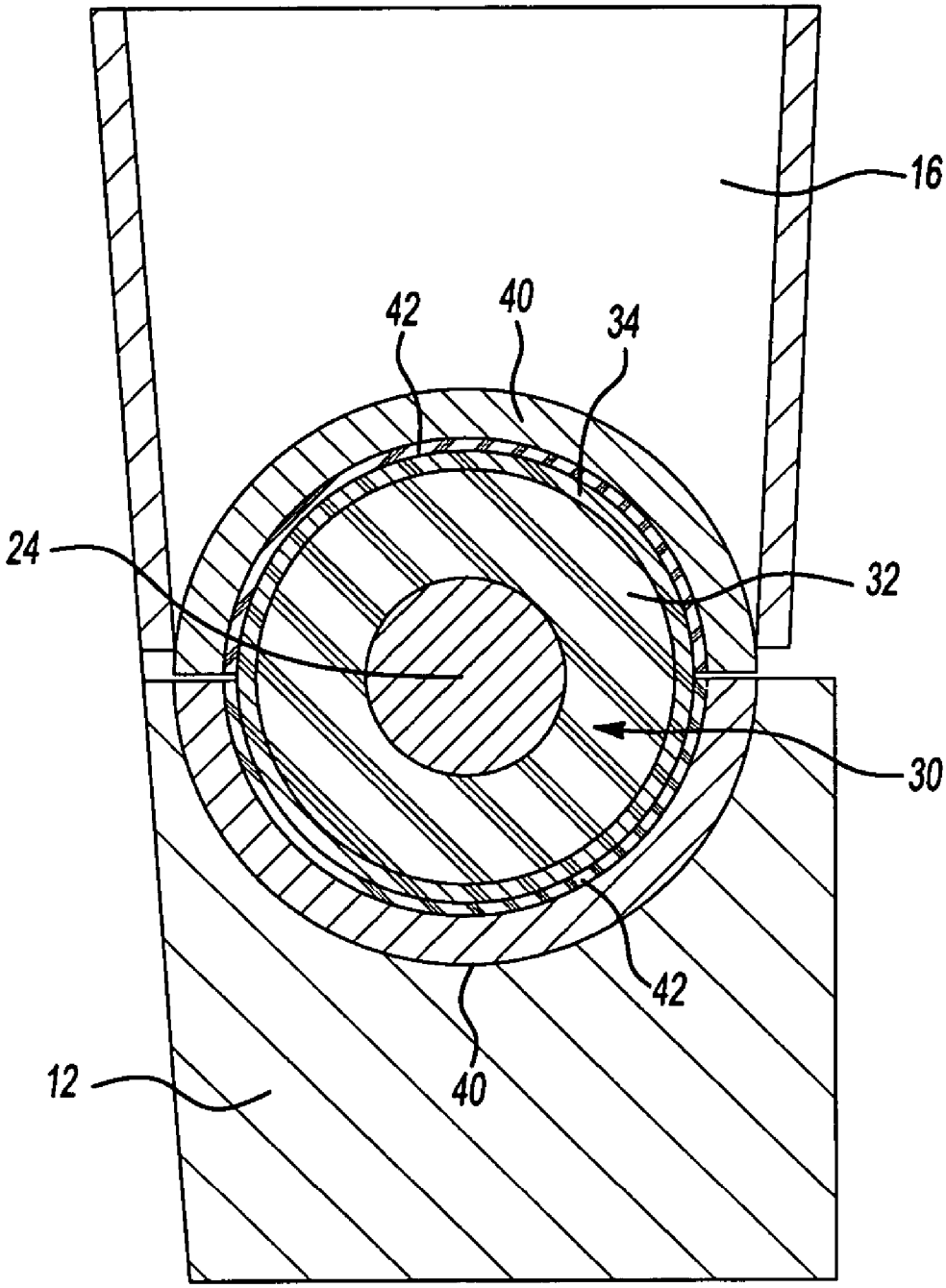
FIG. 4 is a cross-sectional view of the bushing, housing and insert when assembled.

FIG. 4 shows a cross-section of a bushing 30 assembled within the housing 12. The bushings 30 are preferably two-part bushings with rubber seals 32 and plastic sleeves 34. Journal pockets 40 in the housing 12 and in the intake insert 16 at least partially surrounds the bushings 30. Isolators 42 located within the journal pockets 40 and housing 12 surround the bushings 30 and assist in dampening vibrations. The isolators 42 are preferably elastomeric isolators.

Referring back to FIG. 1, the shaft 24 is connected to the actuator 22 through an actuator shaft 44. During operation, the actuator 22 rotates the shaft 24. The actuator 22 senses the engine speed and determines the amount of airflow required and rotates the shaft to move the blades 26, and open and close the airflow passage. The bearing 36 supports the shaft 24 within the housing 12 and allows the shaft 24 to freely rotate. Additionally, the bushings 30 absorb vibrations created during operations to reduce noise created by the intake manifold assembly 10 and compensate for any differences in thermal expansion between the shaft 24 and the housing 12.

The mountings for the actuator 22 are manufactured from the same mold as the housing 12 to reduce manufacturing variations among the parts and lowering the resultant vibrations. The intake insert 16 provides support for the shaft assembly 14 through the bearing 36, and bushings 30, and secures the shaft assembly 14 within the housing 12.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An intake manifold assembly comprising:

a shaft mounted within an intake manifold housing;

a bushing secured to each end of said shaft, wherein said bushing includes a rubber seal surrounding the shaft and a plastic sleeve surrounding the rubber seal;

a locator supported on said shaft between said bushings; and a bearing supported on said shaft adjacent said locator.

2. The intake manifold shaft assembly of claim 1, wherein said shaft is retained within said intake manifold housing by load applied to said bearing.

3. The intake manifold assembly of claim 1, wherein journal pockets are located in said intake manifold housing to support said bushings.

4. The intake manifold assembly of claim 3, wherein an isolator is supported in each of said journal pockets, said isolators at least partially surrounding the corresponding bushings.

5. The intake manifold assembly of claim 4, wherein said isolators are formed of an elastomeric material.

6. The intake manifold assembly of claim 3, wherein journal pockets are located within an insert installed in said intake manifold housing, said journal pocket of said insert and said intake manifold housing mating to support said bushings.

7. The intake manifold assembly of claim 1, wherein there are additional bushings spaced along said shaft.

8. The intake manifold assembly of claim 1, wherein said shaft is metal.

9. An intake manifold assembly comprising:

a shaft mounted within an intake manifold housing having a bushing secured to each end and a locator supported on said shaft between said bushings, wherein said bushing includes a rubber seal surrounding said shaft and a plastic sleeve surrounding the rubber seal;

journal pockets located in said intake manifold housing to support said bushings; and journal pockets located within an insert installed in said intake manifold housing, said journal pockets of said insert and said intake manifold housing mating to support said bushings.

10. The intake manifold shaft assembly of claim 9, wherein a bearing is supported on said shaft adjacent said locator, and said shaft is retained within said intake manifold housing by load applied to said bearing.

11. The intake manifold assembly of claim 9, wherein an isolator is supported in each of said journal pockets, said isolators at least partially surrounding the corresponding bushings.

12. The intake manifold assembly of claim 11, wherein said isolators are formed of an elastomeric material.

13. The intake manifold assembly of claim 9, wherein there are additional bushings spaced along said shaft.

14. The intake manifold assembly of claim 9, wherein said shaft is metal.

15. An intake manifold assembly comprising:

a shaft supporting a plurality of blades within an intake manifold housing;

a bushing secured within the intake manifold housing to each end of the shaft for supporting rotation of the shaft, the bushing including a rubber sleeve surrounding the shaft and a plastic sleeve surrounding the rubber sleeve;

a locator located along the shaft that is received within the intake manifold housing; and a single bearing disposed between the ends of the shaft for axially locating the metal shaft within the intake manifold housing.

16. The assembly as recited in claim 15, wherein the intake manifold housing includes a journal pocket including an isolator surrounding the plastic sleeve of the bushing in an assembled condition.

17. The assembly as recited in claim 15, including a bushing secured between one of the bushings at each end of the shaft and the locator.

18. The assembly as recited in claim 17, wherein the single bearing and the locator are disposed between one pair of the plurality of blades.

* * * * *